US006014878A

United States Patent [19]

Shen

[11] Patent Number: 6,014,878

[45] Date of Patent: Jan. 18, 2000

[54] LOCK WITH A FREELY ROTATABLE OUTSIDE HANDLE

[76] Inventor: Mu-Lin Shen, No. 32, Lane 76, Fu-An Road, Sec. 5, Tainan, Taiwan

[21] Appl. No.: 09/260,751

[22] Filed: Mar. 2, 1999

[51] Int. Cl.[7] ..... E05B 13/10

[52] U.S. Cl. ..... 70/472; 70/149; 70/222; 70/224; 292/DIG. 27

[58] Field of Search ..... 70/149, 218, 222, 70/223, 224, 422, 472; 292/DIG. 27

[56] References Cited

U.S. PATENT DOCUMENTS

| | | | |
|---|---|---|---|
| 235,983 | 12/1880 | Batt | 292/DIG. 27 X |
| 264,575 | 9/1882 | Simon | 292/DIG. 27 X |
| 509,194 | 11/1893 | Carty | 70/149 |
| 576,028 | 1/1897 | Churchill | 70/149 |
| 604,951 | 5/1898 | Anderson et al. | 70/472 |
| 1,779,438 | 10/1930 | Lowe | 70/222 |
| 1,899,686 | 2/1933 | Herst | 70/222 |
| 1,899,996 | 3/1933 | Sullivan | 70/222 |
| 2,059,678 | 11/1936 | Briggs | 70/224 |
| 2,529,230 | 11/1950 | Smith et al. | 70/149 |
| 5,768,926 | 6/1998 | Shen | 70/472 |

*Primary Examiner*—Lloyd A. Gall
*Attorney, Agent, or Firm*—Alan Kamrath; Oppenheimer, Wolff & Donnelly, LLP

[57] ABSTRACT

An outside handle assembly of a lock includes an outside lever handle, an outside handle spindle secured to the outside lever handle to rotate therewith and including a first slot defined in a periphery thereof, and an actuating spindle mounted in the outside handle spindle and operably connected to a retractor. The actuating spindle includes a second slot aligned with the first slot of the outside handle spindle. A catch is mounted in the actuating spindle and has a first end pivoted to the actuating spindle and a second end. A tapping plate is slidably mounted in the actuating spindle and connected to the tail piece to move therewith. When the lock is in an unlocked status, the outside handle spindle and the actuating spindle rotate synchronously, as the second end of the catch extends through the second slot of the actuating spindle into the first slot of the outside handle spindle. When the push button is pressed, the tapping plate is moved to engage with a hooked portion of the first end of the catch and thus pivots the catch during the sliding movement of the tapping plate. The second end of the catch is thus disengaged from the first slot of the outside handle spindle to allow free rotational movement of the outside lever handle.

3 Claims, 6 Drawing Sheets

LOCK WITH A FREELY ROTATABLE OUTSIDE HANDLE

BACKGROUND OF THE INVENTION

1. Field of the Invention

The present invention relates to a lock with an outside handle that rotates freely when the lock is in a locked status.

2. Description of the Related Art

Lever handles are used in cylindrical locks for providing easy operation by handicapped people, yet the locks are more apt to be damaged as the members of the locks are subjected to greater torque when turning the lever handles. The possibility of damage to the lock is increased if the lock is in a locked status and the user is not aware of it and forcibly turns the outside lever handle. U.S. Pat. No. 5,768,926 discloses a lock having an exterior door handle that turns freely when the lock is in a locked status, yet a great number of members are required to achieve this function. Assembly of the catch 63 and the plate spring 64 between the actuating spindle 50 and the slider 62 is troublesome and labor intensive as the opening 54 of the actuating spindle 50 and the recess 624 of the slider 62 renders a difficult assembly procedure.

The present invention is intended to provide a lock with a freely rotatable outside handle that can be assembled easily to mitigate and/or obviate the above problem.

SUMMARY OF THE INVENTION

A lock in accordance with the present invention comprises an inside handle assembly having a push button and a tail piece operably connected to the push button, an outside handle assembly, a latch assembly with a latch bolt, and a chassis having a retractor mounted therein for retracting the latch bolt. The outside handle assembly comprises:

an outside lever handle;

an outside handle spindle secured to the outside lever handle to rotate therewith and including a first slot defined in a periphery thereof;

an actuating spindle mounted in the outside handle spindle and operably connected to the retractor, the actuating spindle including a second slot defined in an upper side thereof and aligned with the first slot of the outside handle spindle;

a catch mounted in the actuating spindle and having a first end pivoted to the actuating spindle and a second end, the first end of the catch further including a hooked portion, the second end of the catch including a block formed on an upper side thereof and an arcuate recess defined in an underside thereof to thereby define a sharp end edge;

a tapping means slidably mounted in the actuating spindle and including a tapping section for releasably engaging with the hooked portion of the catch, the tapping means further including a protruded section for releasably engaging with the second end of the catch, the tapping means being connected to the tail piece to move therewith; and a spring mounted in the actuating spindle for biasing the tapping section of the tapping means away from the hooked portion of the catch;

wherein when the lock is in an unlocked status, the tapping section of the tapping means disengages from the hooked portion of the catch under the action of the spring while the protruded section of the tapping means engages with the sharp end edge of the second end of the catch such that the block is moved upwardly through the second slot of the actuating spindle into the first slot of the outside handle spindle, thereby allowing synchronous rotational movements of the outside handle spindle and the actuating spindle; and wherein when the push button is pressed, the tapping means is moved toward the outside lever handle and compresses the spring such that the tapping section of the tapping means engages with the hooked portion of the catch and thus pivots the catch during the sliding movement of the tapping means to move the second end of the catch downwardly, such that the block of the catch disengages from the first slot of the outside handle spindle while the arcuate recess of the second end of the catch engages with the protruded section of the tapping means to allow free rotational movement of the outside lever handle.

In an embodiment of the invention, the tapping means includes two carrier plates respectively securely attached to each of two ends thereof, each carrier plate including two lugs formed on two opposite sides thereof. The actuating spindle includes two track slots defined in two lateral sides thereof for respectively slidably receiving the lugs of each carrier plate.

The second slot of the actuating spindle extends to an end of the actuating spindle to allow easy mounting of the catch.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
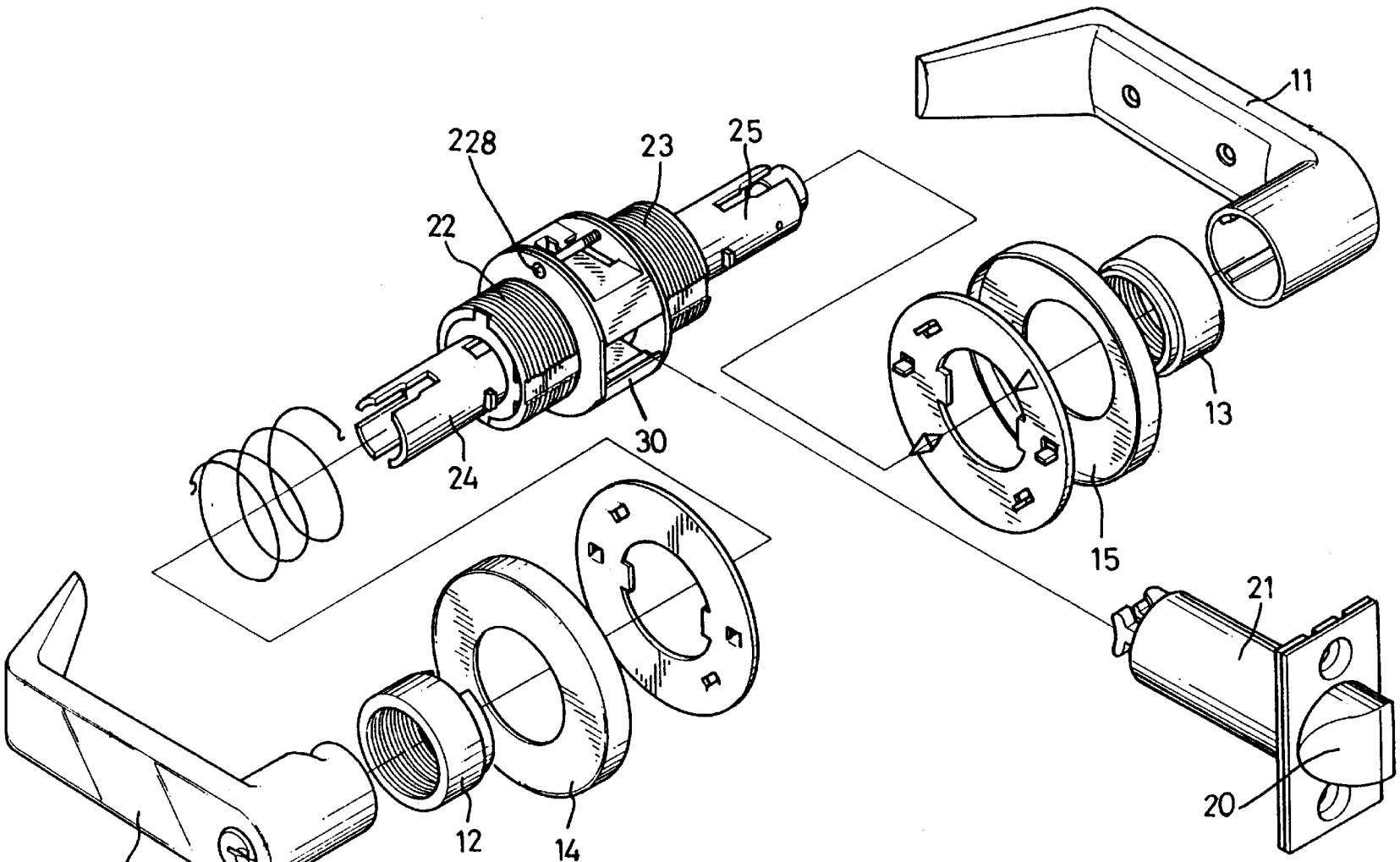
FIG. 1 is an exploded perspective view of a lock in accordance with the present invention.

Referring to the drawings and initially to FIG. 1, a lock in accordance with the present invention generally includes an inside handle assembly, an outside handle assembly, and a latch assembly 21. The outside handle assembly includes an outside lever handle 10, an outside sleeve tube 12, an outside rose 14, an outside handle spindle 24 secured to the outside lever handle 10 to rotate therewith, and an outside sleeve 22. The inside handle assembly includes an inside lever handle 11, an inside sleeve tube 13, an inside sleeve rose 15, an inside handle spindle 25 secured to the inside lever handle 11 to rotate therewith, and an inside sleeve 23, which is conventional and therefore not further described. When the lock is in an unlocked status, operation of either lever handle 10, 11 retracts a latch bolt 20 of the latch assembly 21 via transmission of a retractor 31 (FIG. 3) in a chassis 30, which is also conventional and therefore not further described.

Figure 2:
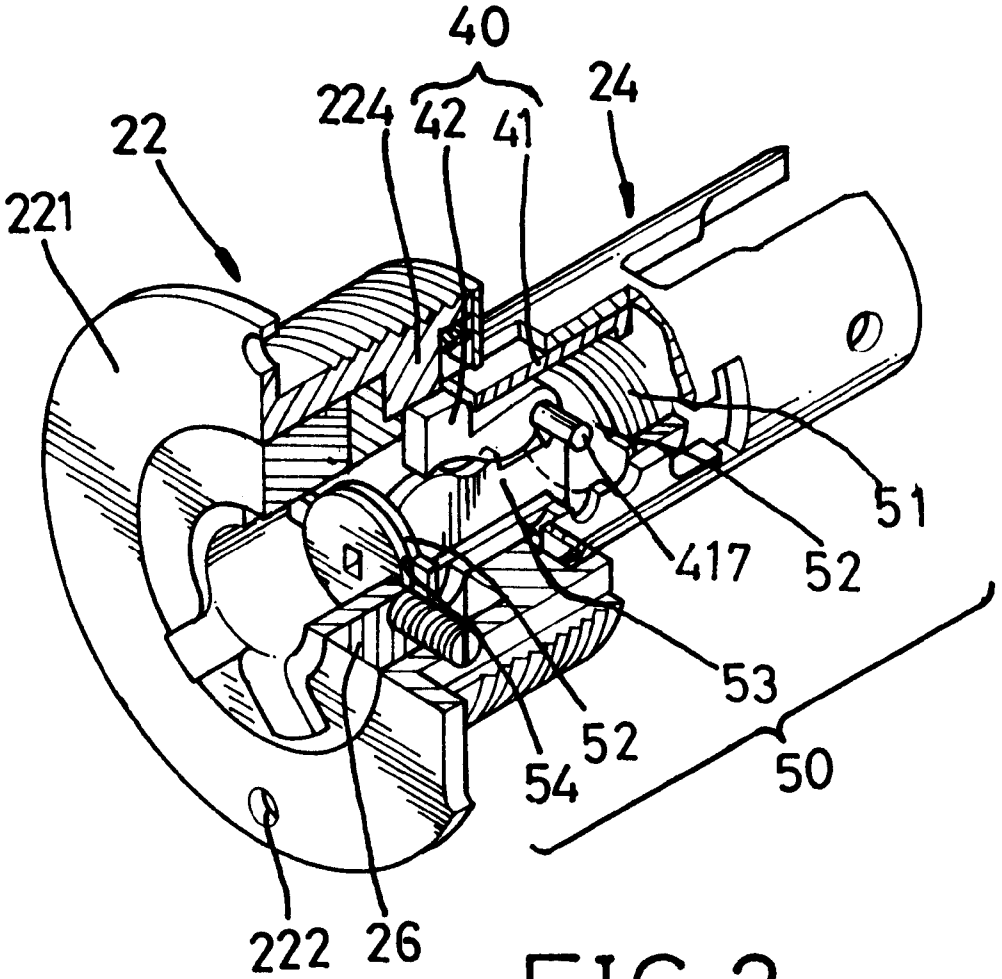
FIG. 2 is a perspective view, partly cutaway, of a portion of an outside handle assembly of the lock in accordance with the present invention.
Figure 3:
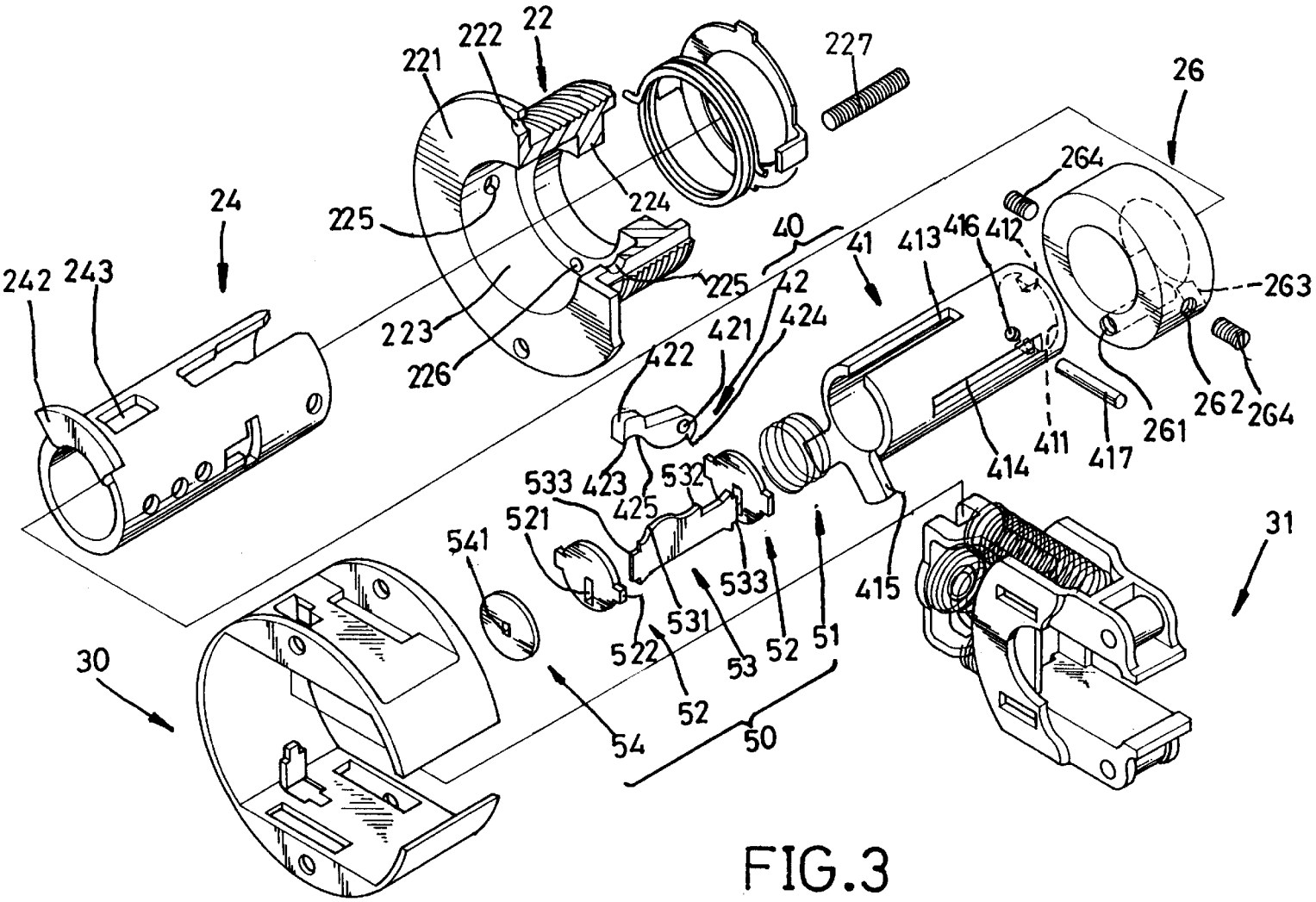
FIG. 3 is an exploded perspective view of the portion of the outside handle assembly.

Referring to FIGS. 2 and 3, the outside sleeve 22 includes a flange 221 formed on an outer periphery of a first end thereof, the flange 221 having two holes 222 defined therein so as to be secured to the chassis 30 by bolts 228 (FIG. 1). A flange 224 is formed on an inner periphery of a second end of the outside sleeve 22, the flange 224 including an axial hole 226 defined therein. The outside sleeve 22 further includes a compartment 223 in the first end thereof, wherein two transverse holes 225 are defined in the first end of the outside sleeve 22. The outside handle spindle 24 includes a stop 242 formed on a first end thereof and a slot 243 defined in a periphery thereof. The stop 242 is received in the compartment 223 when the outside handle spindle 24 is mounted in the outside sleeve 22.

Figure 4:
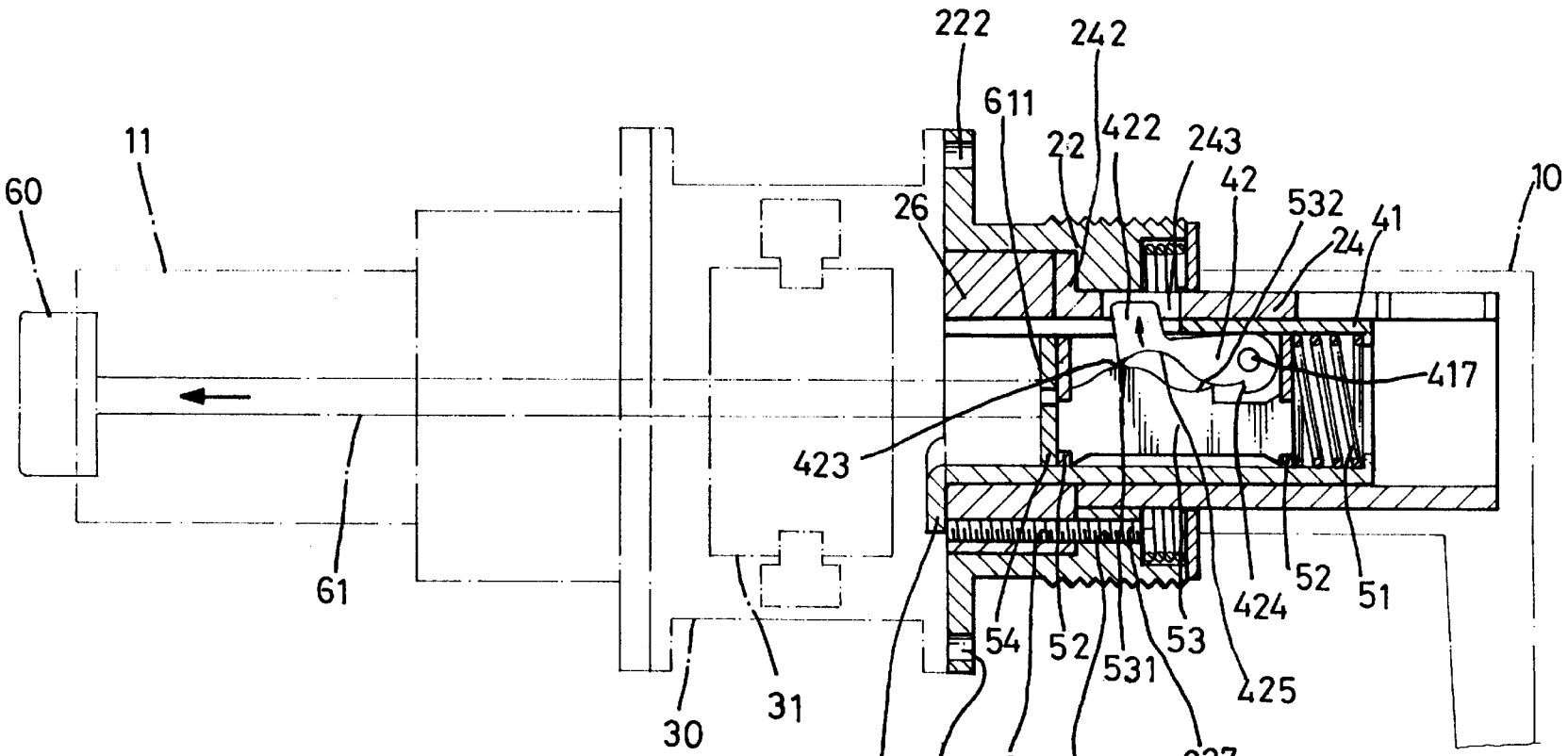
FIG. 4 is a schematic sectional view of the portion of the outside handle assembly, wherein the outside lever handle is in an operative status.

Also mounted in the compartment 223 is a restricting sleeve 26 that includes an axial screw hole 261 and two screw holes 262 defined in a periphery thereof. A screw 264 is extended through each screw hole 262 of the restricting sleeve 26 and an associated hole 225 of the outside sleeve 22, and a screw 227 is extended through the screw hole 261 of the restricting sleeve 26 and the hole 226 of the outside sleeve 22, thereby securely mounting the restricting sleeve 26 in the outside sleeve 22, as shown in FIG. 4. A protrusion 263 is formed on an end face of the restricting sleeve 26 to restrain rotational movement of the outside handle spindle 24 as the protrusion 263 will stop the stop 242 of the outside handle spindle 24.

A disengaging means 40 is provided to disconnectably connect the outside handle spindle 24 and the retractor 31 in the chassis 30. The disengaging means 40 includes an actuating spindle 41 that is hollow and has an opening 411 defined in an end thereof. Two restraining members 412 project inwardly from an inner periphery that defines the opening 411. The actuating spindle 41 further includes a slot 413 in an upper side thereof and a track slot 414 in each of two lateral sides thereof. A transmission member 415 is formed on the other end of the actuating spindle 41. The transmission member 415 is operably connected to the retractor 31 that retracts the latch bolt 20 of the latch assembly 21 upon rotation of the outside lever handle 10, which is conventional and therefore not further described. The actuating spindle 41 further includes two aligned holes 416 defined in two lateral sides thereof.

The disengaging means 40 further includes a catch 42 mounted in the actuating spindle 41. The catch 42 includes a first end having a pivotal hole 421 and a second end. A pin 417 is extended through the holes 416 of the actuating spindle 41 and the pivotal hole 421 so as to allow the second end of the catch 42 to pivot about the pin 417. The second end of the catch 42 includes a block 422 on an upper side thereof and an arcuate recess 425 defined in an underside thereof to thereby define a sharp end edge 423. In addition, the first end of the catch 42 includes a hooked portion 424, which will be described later.

A tapping means 50 is mounted in the actuating spindle 41 and actuatable by a push button 60 (FIG. 4) in the inside lever handle 11 to move the catch 42. The tapping means 50 includes two carrier plates 52 and a tapping plate 53 between the carrier plates 52. Each carrier plate 52 includes an engaging slot 521 through which an associated end 533 of the tapping plate 53 is engaged. Each carrier plate 52 further includes two lugs 522 formed on two opposite sides thereof and slidably received in the track slots 414 of the actuating spindle 41, respectively. Thus, the tapping means 50 (including the carrier plates 52 and the tapping plate 53) are slidable in the actuating spindle 41 under guidance by the track slots 414. The tapping plate 53 further includes a tapping section 532 releasably engagable with the hooked portion 424 of the catch 42. The tapping plate 53 further includes a protruded section 531 on an upper side thereof, which will be described later. A further plate 541 is slidably mounted in the actuating spindle 41 and includes a hole 541 engaged with an end of a tail piece 61. The other end of the tail piece 61 is connected to the push button 60 to move therewith, as shown in FIG. 4. In addition, a spring 51 is mounted in the actuating spindle 41 between the restraining members 412 and the carrier plate 53 adjacent to the restraining members 412.

When the lock is in an unlocked status, referring to FIG. 4, the tapping section 532 disengages from the hooked portion 424 of the catch 42 under the action of the spring 51 while the protruded section 531 engages with the sharp end edge 423 of the second end of the catch 424 such that the block 422 is moved upwardly through the slot 413 of the actuating spindle 41 into the slot 243 of the outside handle spindle 24. Thus, the outside handle spindle 24 and the actuating spindle 41 are engaged together by the block 422 of the catch 42 to rotate synchronously. Accordingly, rotation of either lever handle 11, 10 retracts the latch bolt 20 of the latch assembly 21.

Figure 5:
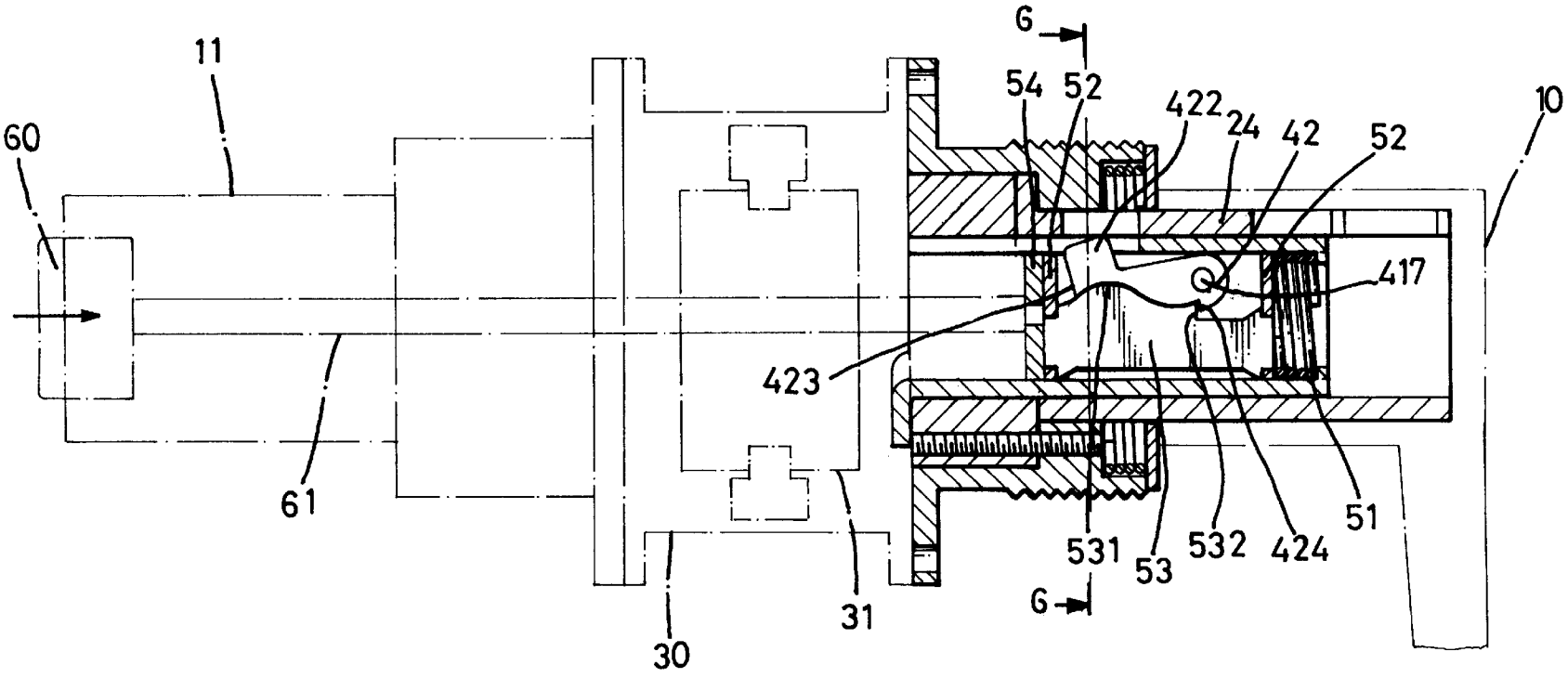
FIG. 5 is a sectional view similar to FIG. 4, wherein the push button is pressed and the outside lever handle may rotate freely.
Figure 6:
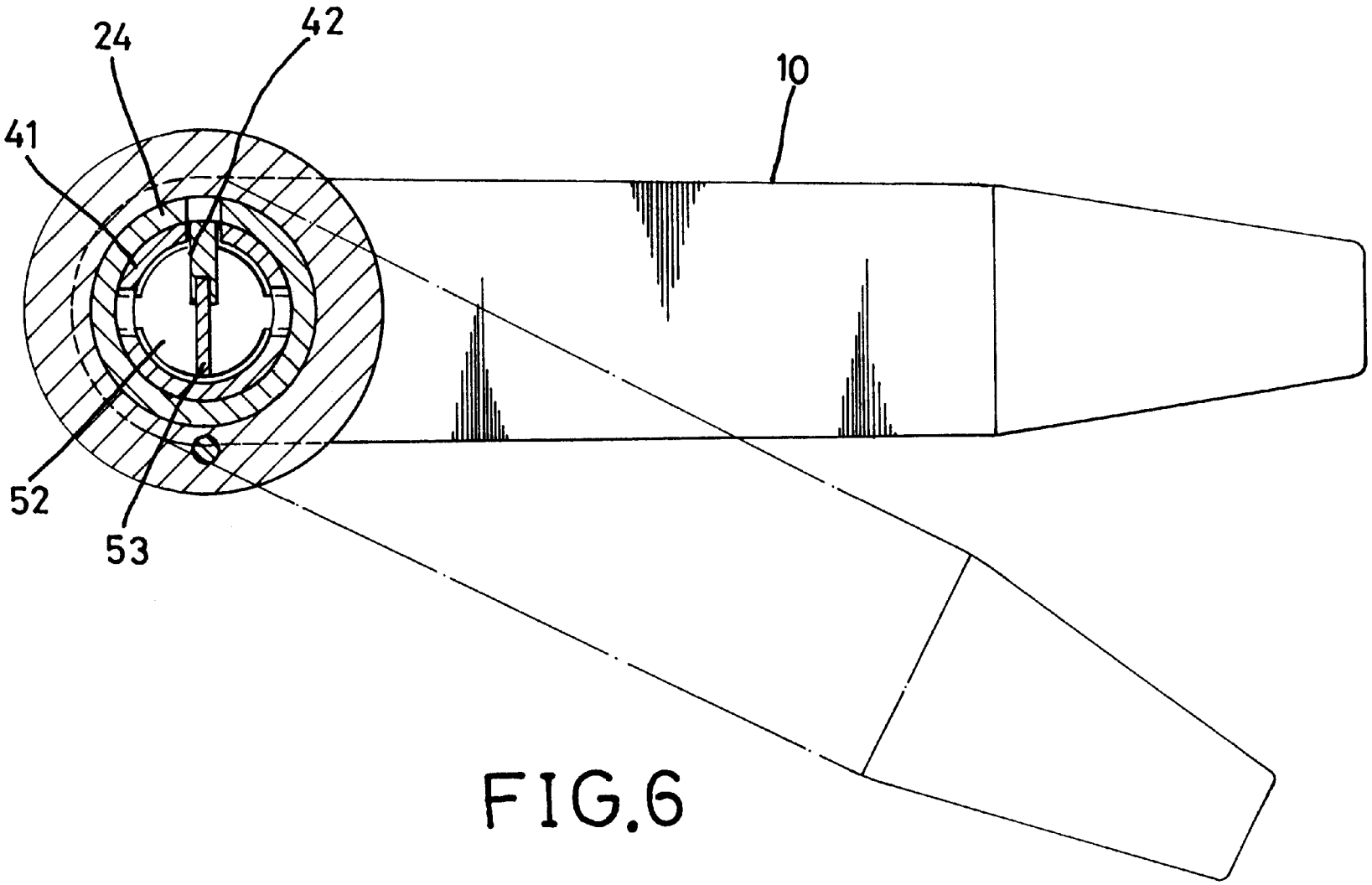
FIG. 6 is a sectional view taken along line 6—6 in FIG. 5.

When the push button 60 is pressed to and retained in a locked status, as can be seen from FIG. 5, the tapping means 50 is moved toward the outside lever handle 10 and compresses the spring 51. The tapping section 532 of the tapping plate 53 engages with the hooked portion 424 of the catch 42 and thus pivots the catch 42 during the rightward movement of the tapping plate 53. As a result, the second end of the catch 42 moves downwardly, such that the block 42 disengages from the slot 243 of the outside handle spindle 24 while the arcuate recess 425 of the second end of the catch 42 engages with the protruded section 531 of the tapping plate 53. Accordingly, the outside lever handle 24 disengages from the actuating spindle 41 such that the outside lever 10 rotates freely when it is turned (see the phantom lines in FIG. 6).

According to the above description, it is appreciated that the structure of the lock in accordance with the present invention is simpler than that disclosed in U.S. Pat. No. 5,768,926 and can be easily assembled. In addition, the catch 42 is pivoted to the actuating spindle 41 and thus has a reliable connection with improved structural strength. Furthermore, the slot 413 extends to an end of the actuating spindle 41 to allow easy mounting of the catch 42.

Although the invention has been explained in relation to its preferred embodiment, it is to be understood that many other possible modifications and variations can be made without departing from the spirit and scope of the invention as hereinafter claimed.

What is claimed is:

1. A lock comprising an inside handle assembly having a push button and a tail piece operably connected to the push button, an outside handle assembly, a latch assembly with a latch bolt, and a chassis having a retractor mounted therein for retracting the latch bolt, the outside handle assembly comprising:

an outside lever handle;

an outside handle spindle secured to the outside lever handle to rotate therewith and including a first slot defined in a periphery thereof;

an actuating spindle mounted in the outside handle spindle and operably connected to the retractor, the actuating spindle including a second slot defined in an upper side thereof and aligned with the first slot of the outside handle spindle;

a catch mounted in the actuating spindle and having a first end pivoted to the actuating spindle and a second end, the first end of the catch further including a hooked portion, the second end of the catch including a block formed on an upper side thereof and an arcuate recess defined in an underside thereof to thereby define a sharp end edge;

a tapping means slidably mounted in the actuating spindle and including a tapping section for releasably engaging with the hooked portion of the catch, the tapping means further including a protruded section for releasably engaging with the second end of the catch, the tapping means being connected to the tail piece to move therewith; and a spring mounted in the actuating spindle for biasing the tapping section of the tapping means away from the hooked portion of the catch;

wherein when the lock is in an unlocked status, the tapping section of the tapping means disengages from the hooked portion of the catch under the action of the spring while the protruded section of the tapping means engages with the sharp end edge of the second end of the catch such that the block is moved upwardly through the second slot of the actuating spindle into the first slot of the outside handle spindle, thereby allowing synchronous rotational movements of the outside handle spindle and the actuating spindle; and wherein when the push button is pressed, the tapping means is moved toward the outside lever handle and compresses the spring such that the tapping section of the tapping means engages with the hooked portion of the catch and thus pivots the catch during the sliding movement of the tapping means to move the second end of the catch downwardly, such that the block of the catch disengages from the first slot of the outside handle spindle while the arcuate recess of the second end of the catch engages with the protruded section of the tapping means to allow free rotational movement of the outside lever handle.

2. The lock as claimed in claim 1, wherein the tapping means includes two carrier plates respectively securely attached to each of two ends thereof, each said carrier plate including two lugs formed on two opposite sides thereof, and wherein the actuating spindle includes two track slots defined in two lateral sides thereof for respectively slidably receiving the lugs of each said carrier plate.

3. The lock as claimed in claim 1, wherein the second slot of the actuating spindle extends to an end of the actuating spindle.

* * * * *